US006247335B1

(12) United States Patent
Schaeberle et al.

(10) Patent No.: US 6,247,335 B1
(45) Date of Patent: Jun. 19, 2001

(54) CIRCULAR KNITTING MACHINE

(75) Inventors: Erwin Schaeberle, Gaeufelden; Klaus Kunde, Kohlberg; Armin Mueller, Stuttgart, all of (DE)

(73) Assignee: Terrot Strickmaschinen GmbH, Stuttgart (DE)

( * ) Notice: Subject to any disclaimer, the term of this patent is extended or adjusted under 35 U.S.C. 154(b) by 0 days.

(21) Appl. No.: 09/583,338

(22) Filed: May 31, 2000

(30) Foreign Application Priority Data

Jun. 1, 1999 (DE) ..... 199 25 171

(51) Int. Cl.[7] ..... D04B 9/14
(52) U.S. Cl. ..... 66/9 B; 66/168
(58) Field of Search ..... 66/9 R, 9 B, 168, 66/8

(56) References Cited

U.S. PATENT DOCUMENTS 5,546,768 8/1996 Kuhrua et al. .
5,577,402 11/1996 Kuhrua et al. .
5,685,176 11/1997 Kuhrua et al. .

FOREIGN PATENT DOCUMENTS

0742852 * 1/1998 (EP) ..... 66/133
WO 97/13018 4/1997 (WO) .
WO 97/13019 4/1997 (WO) .
WO 97/48844 12/1997 (WO) .

* cited by examiner

*Primary Examiner*—Danny Worrell
(74) *Attorney, Agent, or Firm*—Barry R. Lipsitz

(57) ABSTRACT

A circular knitting machine for producing knitted fabrics with combed-in fibers, comprising a needle cylinder, at least one carding device with a comb-in wheel and an extraction device for waste fibers, which produces knitted facbrics of a high quality and requires as little maintenance as possible. The extraction device has at least one extraction nozzle for generating a directional extraction flow.

35 Claims, 4 Drawing Sheets

CIRCULAR KNITTING MACHINE

The present disclosure relates to the subject matter disclosed in German Application No. 199 25 171.1 of Jun. 1, 1999, the entire specification of which is incorporated herein by reference.

The invention relates to a circular knitting machine for producing knitted fabrics with combed-in fibers, comprising a needle cylinder, at least one carding device with a comb-in wheel and an extraction device for waste fibers.

A circular knitting machine of this type is known from EP 0 742 852 B1.

Such circular knitting machines are used to work clusters of fiber bands (sliver clusters) into knit loops.

Proceeding from this state of the art the object underlying the invention is to provide a circular knitting machine which produces knitted fabrics of a high quality and requires as little maintenance as possible.

This object is accomplished in accordance with the invention, in the circular knitting machine specified at the outset, in that the extraction device has at least one extraction nozzle for generating a directional extraction flow.

By providing an extraction nozzle, the extraction flow may be directed and, in particular, those areas of the circular knitting machine, in which more waster fibers are generated, may be acted upon with the extraction flow. Such an area is, in particular, the comb-in area, in which a needle hook of a knitting needle removes a cluster of fibers from the comb-in wheel. The mechanical action of this needle hook on the fibers can lead to the detachment of fiber particles. Since detached fiber particles, on the one hand, settle in the circular knitting machine and soil it and, on the other hand, fall onto the knitted fabric and may reduce the quality of the knit, the extraction device is provided for extraction. In the device of EP 0 742 852 B1, the extraction device is of a funnel-shaped design with one end open downwards so that no selective direction of the extraction flow is possible but only a type of "global" suction effect occurs. With this device known from the state of the art waste fibers cannot, therefore, be carried away to an adequate and also precise extent. This problem is solved by the inventive extraction nozzles.

The inventive extraction device may be used particularly advantageously when the circular knitting machine comprises an air flow guiding device for orienting fibers in an orientation air flow. The air flow guiding device also serves to work the free ends of the fiber clusters into the stitch or loop fabric. As a result, a fiber-band, high-pile knitted fabric with reversed fiber cluster loops can, in particular, be produced.

As a result of the orientation air flow, bundles of fibers are oriented for working into a knitted fabric at their free ends. Two types of fluid flows are therefore effective in such a circular knitting machine, namely the extraction flow and an orientation air flow. In the device known from EP 0 742 852 B1 the orientation air flow is affected by the extraction flow since the latter is non-directional and acts globally on a knitting area. In the case of the inventive device, on the other hand, the extraction flow may be directed and then only those areas, in which waste fibers occur, are selectively acted upon locally.

It is, therefore, particularly favorable when the extraction nozzle or extraction nozzles are arranged and designed in such a manner that the respective extraction flow is essentially decoupled from the orientation air flow. As a result, the orientation air flow remains unaffected by the extraction flow and the quality of the take-up of the clusters of fibers is increased in comparison with the device known from the state of the art.

It is favorable to have an extraction nozzle associated with each carding device. As a result, waster fibers are taken away from their main source and a uniform take-up results for each carding device. It is particularly advantageous when an extraction nozzle is associated with each comb-in wheel since the waste fibers result, in particular, at the comb-in wheel.

In order to act on a comb-in wheel selectively with an extraction flow, a longitudinal axis of the extraction nozzle associated with the comb-in wheel is, advantageously, essentially at right angles to an axis of rotation of the comb-in wheel so that no cross flows occur.

Furthermore, it is particularly advantageous when the longitudinal axis of the extraction nozzle is located in a plane of symmetry of the comb-in wheel essentially at right angles to the axis of rotation of the comb-in wheel. This results in an optimum alignment of extraction nozzle and comb-in wheel.

In order to improve the extraction of fiber particles even more, the extraction flow is favorably directed in the same direction as the rotation of the comb-in wheel. As a result, waste fibers loosened from a needle hook are extracted directly and cannot settle at inaccessible locations. Again, waste fibers which are only partially detached and which could become completely loosened during further rotation of the comb-in wheel and then settle in inaccessible areas of the circular knitting machine are, in certain circumstances, loosened entirely by the assisting effect of the extraction flow so that they cannot settle in the machine.

It is particularly favorable when an extraction nozzle is arranged and designed such that the effective area of the extraction flow covers a comb-in area of the comb-in wheel in order to act selectively on one of the main sources of waste fibers with the extraction flow.

An extraction nozzle is favorably arranged and designed such that a lower area of the comb-in wheel facing the needle cylinder is acted upon by the extraction flow. On the one hand, this makes a complete detachment of partially loosened waster fibers possible; on the other hand, the extraction flow is still directed as a result since the area which has to be acted upon is not too large.

In order to extract waste fibers as completely as possible from the comb-in area, the width of a nozzle opening is advantageously greater than the width of the associated comb-in wheel. The width of a nozzle opening is favorably somewhat greater than the width of an associated comb-in wheel, for example, in the order of magnitude of 5 to 10%. The extraction flow is still directed and covers the comb-in area well.

A nozzle opening of an extraction nozzle is favorably arranged at an angle to a horizontal plane. As a result, the extraction flow is directed at an angle upwards and, in particular, may be formed essentially tangential to the comb-in wheel. This makes a good discharge of waste particles possible.

It is favorable when an extraction nozzle comprises an aperture element and a connecting element, wherein the aperture element has the same cross-sectional area as the connecting element. As a result, the aperture may, on the one hand, be adapted such that a desired area is acted upon by the extraction flow; on the other hand, the suction capacity is not reduced as a result. The cross section of the aperture element is favorably broadened in a horizontal direction in comparison with the connecting element since in this way, in particular, the comb-in area can be well acted upon by an extraction flow.

In a particularly favorable variation of one embodiment the inventive circular knitting machine has a plurality of carding devices, wherein each carding device comprises its own air flow means for orienting the fibers to be combed in. In this way, large areas of knitted fabric may be produced in an effective manner.

So far, no comments have been given concerning the design of the air flow means. An air flow means favorably has at least one suction element and at least one blower element. Free ends of clusters of fibers may be drawn in by the suction element so that the cluster of fibers can be grasped by a needle hook. This effect can likewise be achieved by a blower element which orients the free ends of the cluster of fibers by means of its blast air flow; the two flows can also interact to increase the effect.

The air flow means favorably comprises a take-up air flow means, with which a suction element and a blower element are arranged so as to face one another. This take-up air flow means serves to orient the free ends of the combed-in clusters of fibers in the air flow so that they can be grasped by a needle and can be worked into the loops. By providing a suction element and a blower element, which are arranged so as to face one another, the blast air flow and the suction air flow reinforce one another so that a particularly good orientation of the free fiber ends is achieved.

For this purpose, an air flow of the suction element is favorably conducted outwards away from a central axis of the circular knitting machine and an air flow of the blower element is conducted outwards away from a central axis of the circular knitting machine in order to orient the free fiber ends outwards.

It is particularly advantageous, when several types of fibers, for example, several colors (jacquard pattern) are intended to be worked in, that the inventive circular knitting machine comprises a plurality of feed systems for fibers and threads, wherein a feed system comprises n carding devices for the take-up of n types of fibers in loops. Each carding device is then provided for combing in one type of fibers.

It is particularly favorable when a blower element is arranged between adjacent carding devices of the feed system. If a first type of fibers is combed in and the needle cylinder rotates further, there is the risk of these combed-in fibers becoming caught on the comb-in wheel of the next carding device and, in particular, its card clothing. As a result of the blower element, the fibers combed in in the first carding device may be oriented such that they come into contact essentially during the rotation of the needle cylinder without contact to the comb-in wheel or the fibers of the adjacent carding device (in the direction of rotation of the needle cylinder) which are to be combed in; the fibers already combed in can be "pulled through" under the adjacent carding device due to orientation by the blower element. It is then particularly favorable when, in relation to a comb-in area, the blower element is arranged outwards relative to a central axis of the circular knitting machine. The blast air flow for orienting the combed-in fibers of the first type of fibers may then be oriented contrary to the air flow for the take-up of all the fibers. In this way, during the "pulling through" of the combed-in first fibers under the comb-in wheel of the second fibers the free ends are "out of the way" of the needle hook which must comb in the fibers of the second type of fibers in the comb-in area of the second carding device for this second type of fibers. An air flow of the blower element is advantageously directed inwards in the direction of a central axis of the circular knitting machine.

A particularly good knitting result is achieved when a suction element and a blower element are arranged so as to be oppositely located between adjacent carding devices of adjacent feed systems. As a result, the fibers may be oriented together as a last operating step in an operating cycle for the take-up of various types of fibers in loops and can be grasped and worked in by a needle hook.

An extraction nozzle is favorably associated with each carding device.

It is favorable when the extraction nozzles are each arranged between adjacent blower elements. As a result, it is possible in a constructionally simple manner for the extraction flow to be discharged and the comb-in area to be acted upon essentially completely.

It is particularly advantageous when the extraction nozzles open into a suction chamber. The suction chamber makes the required vacuum for all the extraction nozzles available and it is then not necessary for each extraction nozzle to be connected individually to a vacuum generator.

The extraction nozzles favorably open into a lower end surface of the suction chamber so that this does not take up any unused space.

The suction chamber is advantageously designed so as to be rotationally symmetrical in order, in particular, to have the effect that no "dead areas" can form in it, in which waste fibers could be deposited.

It is particularly favorable when an axis of the suction chamber coincides with the central axis of the circular knitting machine.

A particularly simple construction of the inventive circular knitting machine may be achieved in that an air discharge means of a suction element of the air flow guiding device is connected to the suction chamber. As a result, the suction chamber may be used at the same time for the discharge of fiber particles and for generating the necessary vacuum in order to generate a suction air flow.

A nozzle opening of an extraction nozzle is favorably arranged so as to be set back in a radial direction in relation to needles held on the needle cylinder in order to have a good discharge of waste fibers generated in the comb-in area.

In order to avoid any effect on the orientation air flow and the extraction flow to a great extent in a vertical direction, as well, a lower end of a nozzle opening of an extraction nozzle is favorably arranged in vertical direction above an aperture opening of a blower element of the air flow guiding device.

In order to prevent waste fibers from penetrating corresponding machine areas, a seal is favorably arranged between an extraction nozzle and a carding device.

Additional features and advantages of the invention are the subject matter of the following description as well as the drawings illustrating several embodiments.

Figure 1:
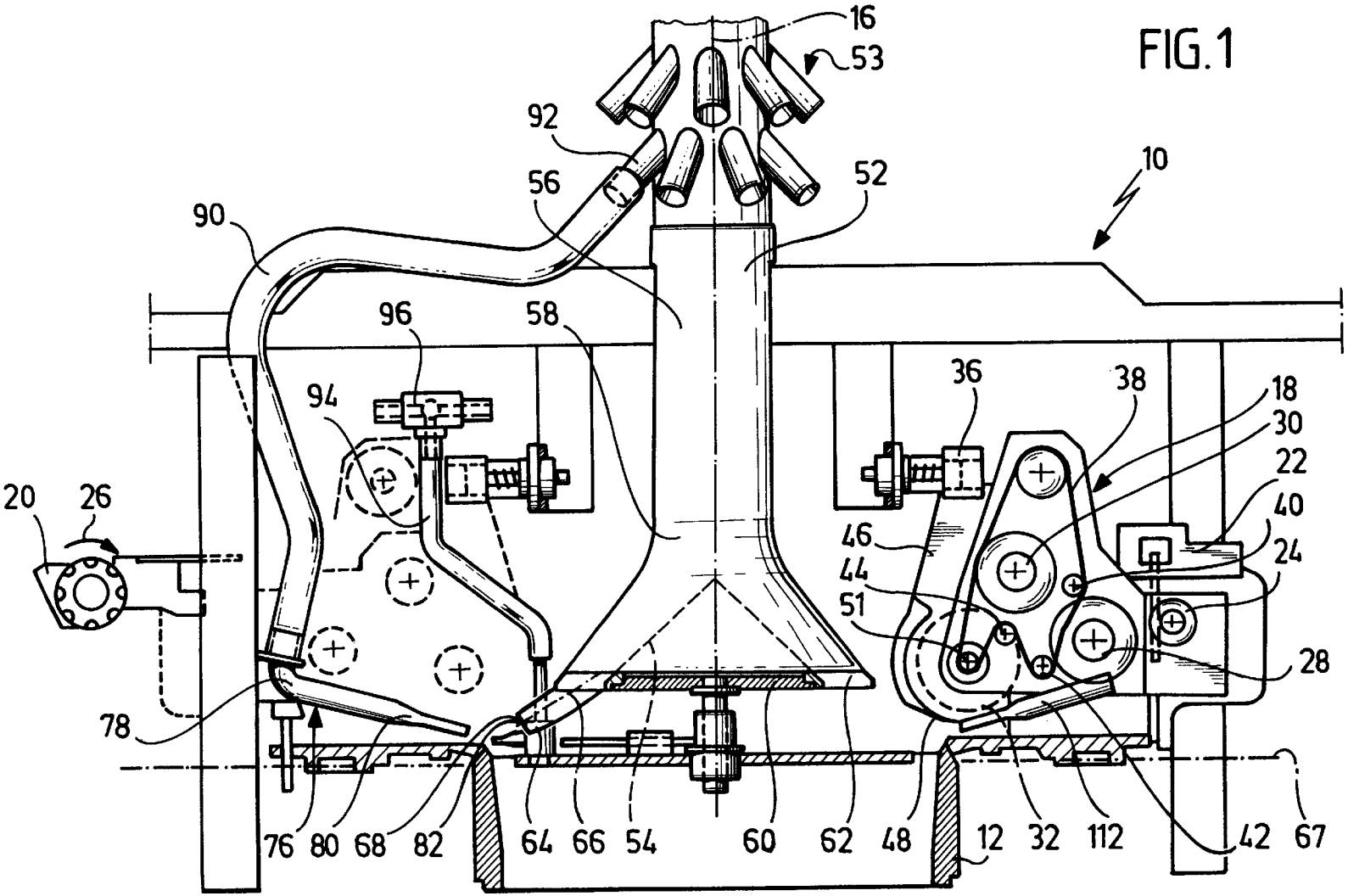
FIG. 1 shows a schematic, lateral sectional view of an inventive circular knitting machine.
Figure 2:
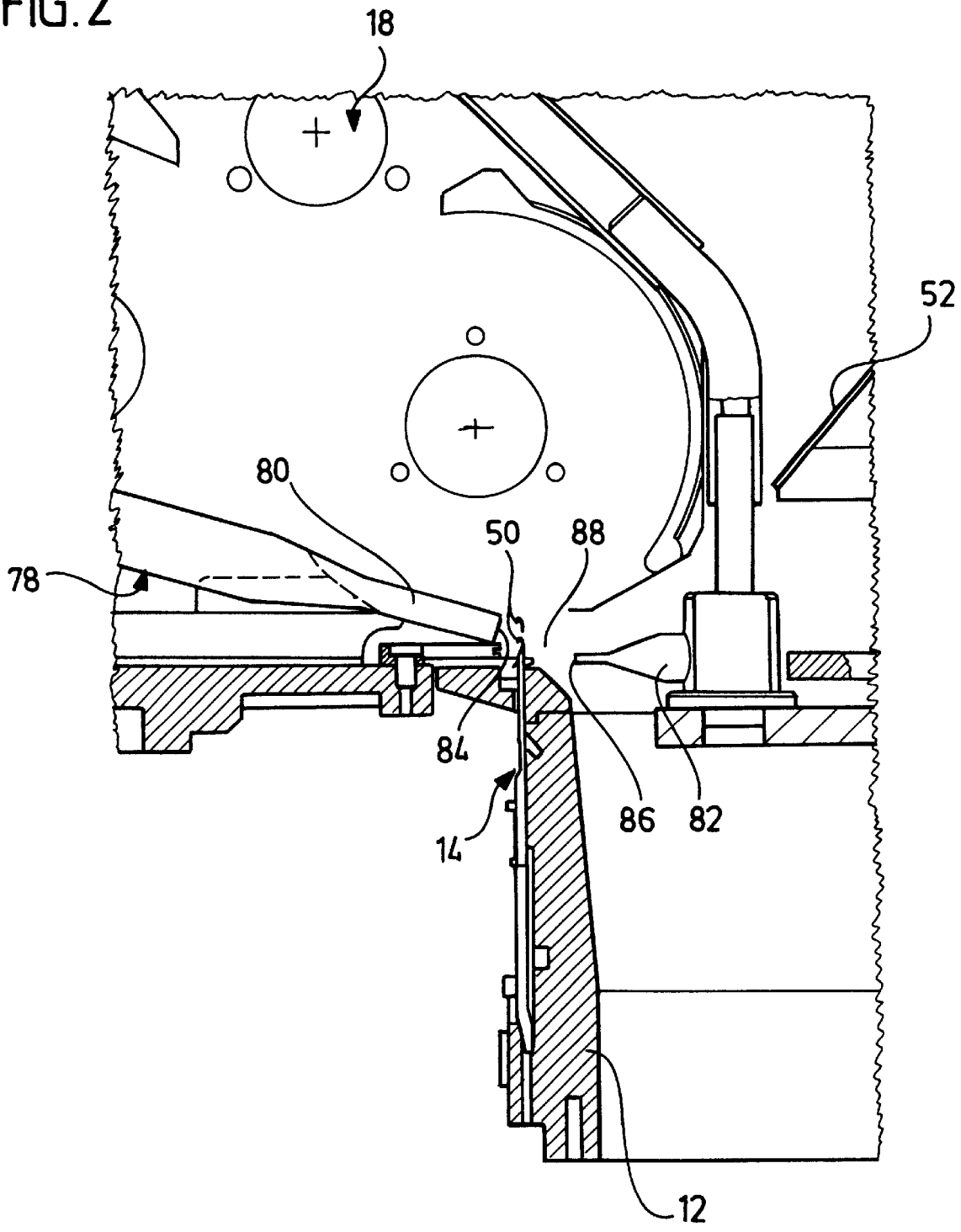
FIG. 2 shows a detailed view of the circular knitting machine in accordance with FIG. 1 (left side) in a section A—A according to FIG. 4.
Figure 3:
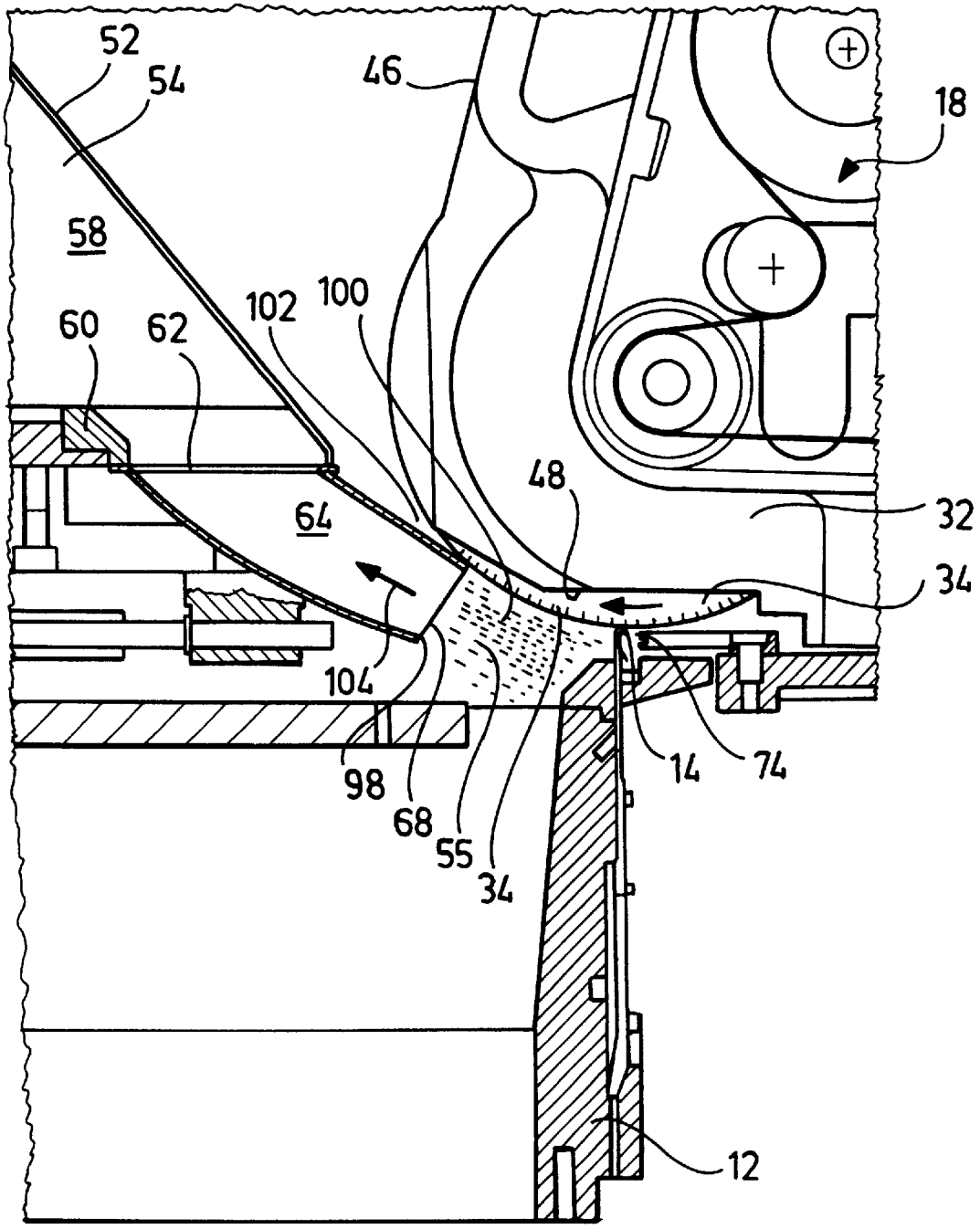
FIG. 3 shows a further detailed view of the circular knitting machine in accordance with FIG. 1 (right side), showing a carding device in a section B—B according to FIG. 4.

One embodiment of an inventive circular knitting machine, which is illustrated schematically in FIG. 1 and is designated as a whole as 10, comprises a needle cylinder 12 which is rotatably mounted and holds knitting needles 14 (FIGS. 2, 3).

Figure 4:
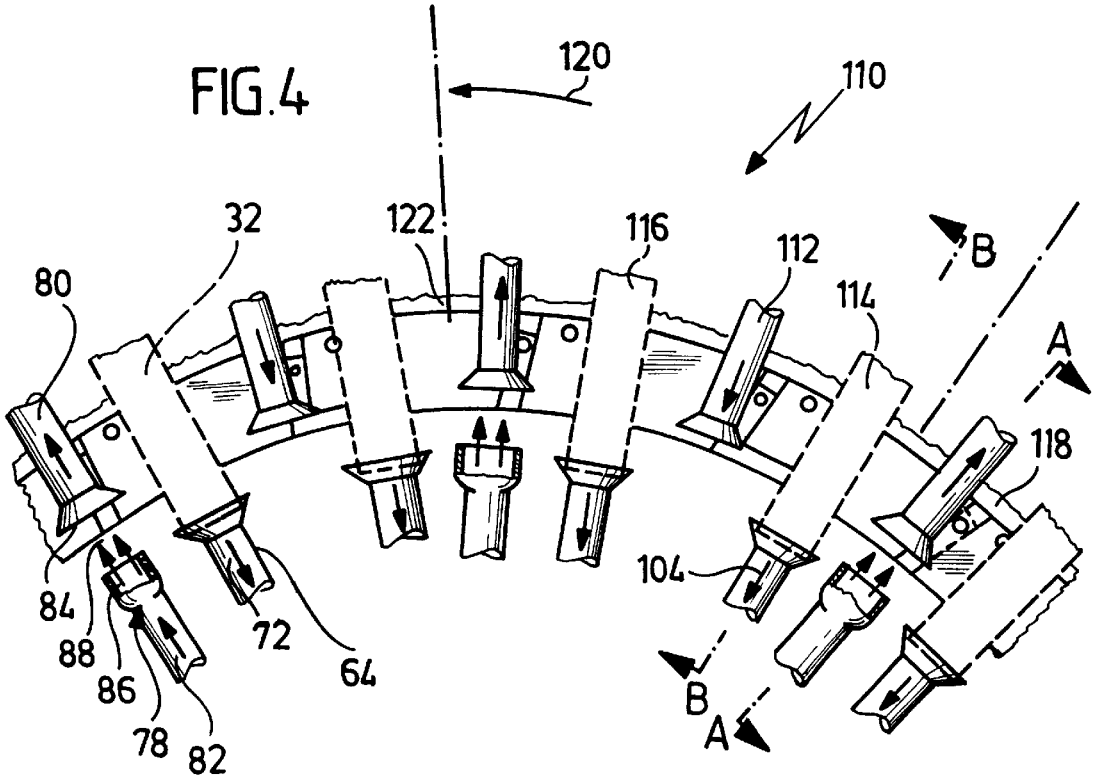
FIG. 4 shows a plan view of one embodiment of an arrangement of extraction nozzles on the inventive circular knitting machine for the production of a two-colored jacquard pattern and FIG. 5 shows a schematic plan view of an extraction nozzle.

A plurality of carding devices, which are each designated as a whole as 18, are arranged in a ring shape around a central axis 16 of the circular knitting machine 10, wherein carding devices adjacent in circumferential direction are spaced from one another (FIG. 4). A carding device comprises a sliver intake 20, a supply roller 24 driven via a drive means 22, for example, a step motor, a separating wheel 28 arranged after the supply roller 24 in relation to a sliver introduction direction 26, a working wheel 30 which is provided with a card clothing (not shown in the Figures) and comb-in wheel 32. The comb-in wheel 32 is provided with a card clothing 34 (FIG. 3).

A drive means 36, for example, a cardan drive is provided for driving the separating wheel 28, the working wheel 30 and the comb-in wheel 32. The transfer of the driving force to the specified wheels 28, 30 and 32 may be brought about via a drive belt 38, wherein corresponding deflecting rollers 40, 42, 44 are then provided.

The carding device 18 has a housing 46 which is open in a lower area 48 facing the needle cylinder 12 so that a needle hook 50 of a knitting needle 14 can take up clusters of fibers to be combed in from the card clothing 34 of the comb-in wheel 32.

Each carding device 18 is aligned radially to the central axis 16, wherein the respective axes of rotation of the supply roller 24, the separating wheel 28, the working wheel 30 and, in particular, the axis of rotation 51 of the comb-in wheel 32 are at right angles to the radial direction and thus also at right angles to the plane defined by the central axis 16 and the radial direction.

An extraction device 53 for waste fibers 55 (FIG. 3) is provided with a funnel-like exhaust hood 52 which is preferably arranged so as to be rotationally symmetrical about the axis 16 and the lower end of which is at a vertical distance from the needle cylinder 12 and extends upwards with a conical area 54, wherein a cylindrical area 56 adjoins the conical area 54. This cylindrical area preferably extends beyond the height of the inventive circular knitting machine 10 and is connected to a vacuum generator (not shown in the Figures). In this way, a suction chamber 58 is formed in the interior of the exhaust hood 52.

The exhaust hood is closed at its lower end 60 facing the needle cylinder 12, wherein it does, however, have at this point, in the vicinity of its edge, openings 62 which themselves are arranged in a ring shape around the axis 16 and wherein such an opening 62 is associated with each carding device 18.

An extraction nozzle 64 is arranged at each opening 62 so that an extraction nozzle 64 is associated with each carding device 18, wherein this nozzle is oriented towards the respective comb-in wheel 32 of the carding device 18. Such an extraction nozzle 64 extends from the lower end 60 of the exhaust hood 52 downwards in the direction of the needle cylinder 12 and in a radial direction away from the axis 16 so that a longitudinal axis 66 of the extraction nozzle 64 forms an angle to a horizontal plane 67 at right angles to the central axis 16. The longitudinal axis 66 of the respective extraction nozzle 64 is thereby located in a plane of symmetry of the associated comb-in wheel 32 which is the plane defined by the radial direction and the central axis 16. Consequently, the extraction nozzle is arranged such that its longitudinal axis 66 is at right angles to the axis of rotation 51 of the associated comb-in wheel 32.

A nozzle opening 68 is likewise arranged at an angle to this horizontal plane 67 so that an extraction flow, which flows away via the extraction nozzle 64 into the suction chamber 58, is at an angle to this horizontal plane. The extraction nozzle 64 is preferably arranged and designed, i.e. the respective angles of the longitudinal axis 66 to the horizontal plane 67 and of the nozzle opening 68 to the horizontal plane 67 are selected such that this extraction flow is tangential to the comb-in wheel 32.

Figure 5:
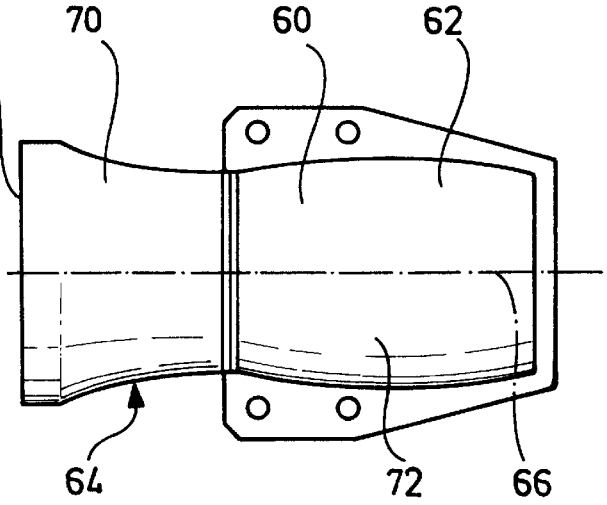

As illustrated in FIGS. 4 and 5, an extraction nozzle 64 comprises an aperture element 70 with the nozzle opening 68 and a connecting element 72 which adjoins the aperture element 70 and provides the connection to the opening 62 in the lower end 60 of the exhaust hood 52. At least in the area of the nozzle opening 68 the aperture element has a somewhat greater cross-sectional width in a horizontal direction (i.e. parallel to the horizontal plane 67). This corresponds to a direction at right angles to the plane of drawing of FIGS. 1 to 3. The cross-sectional area is the same over the length of the nozzle and so the same suction capacity results over its entire length.

The nozzle opening 68 is directed onto a comb-in area 74 (FIG. 3) such that the effective area of an extraction flow flowing away through the extraction nozzle 64 into the suction chamber 58 covers this comb-in area, at which the sliver is combed into the needle hook 50.

In addition, the inventive circular knitting machine 10 has an air flow guiding device which is designated in FIG. 1 as a whole as 76. This comprises a plurality of air flow means 78, the number of which corresponds to the number of feed systems 110 for fibers and threads (FIG. 4). A feed system for the take-up of n types of fibers comprises n carding devices, i.e. one comb-in wheel per type of fibers.

An air flow means 78 itself comprises a suction element designed as a suction nozzle 80 and a blower element designed as a blast nozzle 82 which are arranged so as to be radially aligned with one another, wherein an effective zone 88 is formed between a respective aperture opening 84 of the suction nozzle 80 and an aperture opening 86 of the blast nozzle 82; an orientation air flow 89 can flow in this effective zone and serves for the orientation of free ends of clusters of fibers already combed into loops on one side. In the effective zone 88, the needle hook 50 of a knitting needle 14 is displaceable in vertical direction.

Furthermore, the air flow means 78 of a feed system 110 comprises an additional blast nozzle 112 which is arranged between adjacent carding devices 18 of a feed system 110.

In the embodiment shown in FIG. 4, which serves to produce a two-colored jacquard pattern, a feed system 110 comprises two carding devices, wherein the first carding device 114 serves to comb in a first type of fibers with a first color and the adjacent second carding device 116 for combing in a second type of fibers with a second color. In relation to the central axis 16, the blast nozzle 112 is arranged between these two carding devices 114 and 116 such that its blast air flow acts inwardly.

The suction nozzle 80 has a discharge means 90, for example, a suction line which leads into the cylindrical area 56 of the suction chamber 58 via connections 92 in order to generate a suction air flow of the orientation air flow.

The connections 92 are preferably arranged so as to be oriented downwards at an angle to the central axis 16 so that a suction air flow flows into the cylindrical area 56 of the exhaust hood 52 at an angle and thus has only a small flow component in a horizontal direction. This also prevents part of the extraction flow, which contains waste particles or fibers, from flowing into the discharge means 90 in a reverse direction.

The blast nozzle 82 has a supply means 94, for example, a supply line which is connected to a pressure generator 96 for generating a blast air flow of the orientation air flow.

The aperture opening 86 of the blast nozzle 82 is preferably arranged in relation to the aperture opening 84 of the suction nozzle 80 such that a blast air flow can also be discharged essentially completely through the suction nozzle 80 so that no "stray air flows" occur.

The extraction nozzles 64 are arranged relative to the air flow means 78 in accordance with the invention such that the extraction flow, which acts upon the comb-in area 74 with a vacuum, essentially does not affect the air flow of the adjacent air flow means 78. For this purpose, the individual extraction nozzles 64, which are associated with the comb-in wheels 82 of the associated carding device 18, are each arranged between the air flow means 78 in circumferential direction in relation to the central axis 16. Since the suction nozzle 80 and blast nozzle 82 of such an air flow means are arranged so as to be radially aligned, the extraction nozzles 64 are oriented in a radial direction—like the associated comb-in wheel 32.

The nozzle opening 68 is set back in comparison with the blast nozzle 82 in relation to the radial direction.

The width of the nozzle opening 68 on the aperture element 70 corresponds essentially to the width of the associated comb-in wheel 32, wherein the width of the nozzle opening 68 is somewhat larger so that it is ensured that the extraction flow covers the entire width of the comb-in wheel 32 and a certain area outside it. As a result, care is also taken that the extraction flow cannot pass into the area of the suction and blast air flows of the adjacent suction nozzles 80 and blast nozzles 82 in a circumferential direction.

A lower end 98 of the nozzle opening 68 of the respective extraction nozzle 64 is arranged at a vertical distance to the blast nozzle 82 so that it is also ensured in this way that the extraction flow also does not affect the blast air flow with respect to this direction. This vertical distance is selected such that a lower area 100 of the comb-in wheel 32 can be acted upon with the extraction flow and, in particular, an extraction zone can be formed between, in relation to the vertical direction, knitted fabrics (not shown in the Figures) and the respective comb-in wheel 32, this zone being such that it comprises the comb-in area 74 and an area extending from the knitting needle 14 inwards in the direction of the central axis 16.

A seal 102 is preferably arranged between each extraction nozzle 64 and the housing 46 of the respective carding device 18 and this seal, in particular, prevents waste fibers from passing into the area behind the seal. The seal 102 can be a separate sealing element or also a housing element of the housing 64 which is connected sealingly to an upper surface of the extraction nozzle 64.

The inventive circular knitting machine operates as follows:

The sliver (fiber band) is supplied to each carding device 18 via the respective sliver intake 20, drawn through this carding device, separated into individual fibers in the separating wheel 28, evened out when required by the working wheel 30 and, in the comb-in wheel 32, oriented parallel to the combing in by the respective needle hook 50 by the card clothing 34.

During the circulation of the sliver at the comb-in wheel and, in particular, due to the engagement of the needle hook 50 for the combing in, individual fiber components 55 become loosened. These cause soiling of the circular knitting machine and can, in particular, be deposited on the knitted fabric, as a result of which the quality of the knitted fabric is diminished, for example, due to undesired color effects. As a result of the inventive extraction nozzles 64, the waste fibers 55 which result at the comb-in wheel 32 are extracted so that the soiling of the machine is reduced and, in particular, the quality of the knitted fabric is not diminished. The extraction flow 104, which is generated via the extraction nozzles 64, is preferably directed in the same direction as the rotation of the comb-in wheel 32 in order to achieve a good extraction effect. The extraction flow, which is composed of air and waste fibers, is discharged via the exhaust hood 52.

The clusters of fibers combed into the needle hooks 50 serve as sliver fibers which are to be tied up into loops. A guidance of the threads for the loops takes place in an area 118 which is shown in FIG. 4. For this purpose, a cluster of fibers combed into a needle hook 50 and thus grasped by the needle hook 50 is worked into the loops in a manner known per se with its gripping area grasped by the needle hook 50 (cf., for example, DE 28 17 130 C2, EP 0 742 852 B1). A cluster of fibers worked in in such a manner has free ends.

In the case of the embodiment shown in FIG. 4, two different types of fibers, for example, pile fibers can be worked in in order to generate, for example, a two-colored jacquard pattern. For this purpose, fibers of the first type of fibers are combed in in the comb-in area 74 of the first carding device 114. By rotating the needle cylinder further in the direction 120 this combed-in cluster of fibers passes into the area of the second carding device 116. To avoid the combed-in fibers being grasped by the corresponding comb-in wheel of the second carding device 116, the blast air flow of the blast nozzle 112 orients the fibers already combed in such that these do not project upwards and thus pass through under the second carding device 116 essentially without contact with the comb-in wheel 32 of the carding device 116 during the rotation of the needle cylinder 12. The orientation with the blast air flow also sees to it that the free ends are oriented in the direction of the central axis 16 of the circular knitting machine and so the needles, in particular, which are intended to grasp clusters of fibers of the second type of fibers at the comb-in wheel 32 of the second carding device 116, do not grasp the fibers of the first type of fibers which have already been combed in.

When the needle cylinder is rotated further, the combed-in clusters of fibers of the first type of fibers and of the second type of fibers pass into the area of the take-up air flow guiding means associated with the corresponding feed system 110 and, in particular, into the area of the suction air flow of the suction nozzle 80 and of the blast air flow of the blast nozzle 82. As a result of this orientation air flow the free ends are then oriented so that a needle hook 50 can grasp them and can likewise work them into the loops. They are then cast off (area 122 in FIG. 4). At the end of this take-up process the clusters of fibers no longer have any free ends with respect to the loops.

As a result of providing extraction nozzles 64 in accordance with the invention it is possible for the extraction flow to leave the suction and blast air flows for orienting the clusters of fibers during their take-up into the loops and the orientation flow for preventing the grasping of combed-in fibers by adjacent carding devices essentially unaffected and so no changes need be made by the inventive circular knitting machine with respect to the take-up method for the clusters of fibers into the loops in comparison with known devices but the knitted fabric has a better quality since waste fibers are kept away from the knitted fabric to a great extent by the inventive extraction nozzles 64.

What is claimed is:

1. Circular knitting machine for producing knitted fabrics with combed-in fibers, comprising:

a needle cylinder;

at least one carding device having a comb-in wheel;

an extraction device for waste fibers having at least one extraction nozzle for generating a directional extraction air flow; and an air flow guiding device having one or more air flow means for orienting fibers in an orientation air flow;

wherein the orientation air flow is essentially unaffected by the directional extraction air flow.

2. Circular knitting machine in accordance with claim 1, wherein each carding device has an associated extraction nozzle.

3. Circular knitting machine in accordance with claim 1, wherein each comb-in wheel has an associated extraction nozzle.

4. Circular knitting machine in accordance with claim 3, wherein a longitudinal axis of each extraction nozzle associated with each comb-in wheel is essentially at right angles to an axis of rotation of the comb-in wheel.

5. Circular knitting machine in accordance with claim 4, wherein the longitudinal axis of each extraction nozzle is located in a plane of symmetry of the associated comb-in wheel essentially at right angles to the axis of rotation of the comb-in wheel.

6. Circular knitting machine in accordance with claim 1, wherein the extraction flow is directionally coordinated with a rotation of the comb-in wheel.

7. Circular knitting machine in accordance with claim 1, wherein an effective area of the extraction flow covers a comb-in area of the comb-in wheel.

8. Circular knitting machine in accordance with claim 1, wherein the extraction nozzle is arranged and designed such that a lower area of the comb-in wheel facing the needle cylinder is acted upon by the extraction flow.

9. Circular knitting machine in accordance with claim 8, wherein an extraction zone is formed by the extraction flow between knitted fabric and the comb-in wheel.

10. Circular knitting machine in accordance with claim 1, wherein a width of an opening of the extraction nozzle is equal to or greater than a width of an associated comb-in wheel.

11. Circular knitting machine in accordance with claim 10, wherein the width of the extraction nozzle opening is somewhat greater than the width of the associated comb-in wheel.

12. Circular knitting machine in accordance with claim 1, wherein an opening of an extraction nozzle is arranged at an angle to a horizontal plane.

13. Circular knitting machine in accordance with claim 12, wherein the extraction flow is essentially tangential to the comb-in wheel.

14. Circular knitting machine in accordance with claim 1, wherein the extraction nozzle comprises an aperture element and a connecting element, wherein a cross-sectional area of the aperture element is equal to a cross-sectional area of the connecting element.

15. Circular knitting machine in accordance with claim 14, wherein the cross section of the aperture element is broader in a horizontal direction in comparison with the connecting element.

16. Circular knitting machine in accordance with claim 1, said knitting machine having a plurality of carding devices, each carding device having its own air flow means for orienting combed-in fibers.

17. Circular knitting machine in accordance with claim 16, wherein the air flow means has at least one suction element and at least one blower element.

18. Circular knitting machine in accordance with claim 17, wherein the air flow means comprises a take-up air flow means, a suction element and a blower element being arranged so as to face one another.

19. Circular knitting machine in accordance with claim 18, wherein an air flow of the suction element is conducted outwards away from a central axis of the circular knitting machine.

20. Circular knitting machine in accordance with claim 18, wherein an air flow of the blower element is conducted outwards away from a central axis of the circular knitting machine.

21. Circular knitting machine in accordance with claim 16, further comprising a plurality of feed systems for fibers and threads, wherein each feed system comprises n carding devices for the take-up of n types of fibers in loops.

22. Circular knitting machine in accordance with claim 21, wherein a blower element is arranged between adjacent carding devices of the feed system.

23. Circular knitting machine in accordance with claim 22, wherein in relation to a comb-in area the blower element is arranged outwards relative to a central axis of the circular knitting machine.

24. Circular knitting machine in accordance with claim 22, wherein an air flow of the blower element is directed inwards in a direction of a central axis of the circular knitting machine.

25. Circular knitting machine in accordance with claim 21, wherein a suction element and a blower element are arranged so as to be oppositely located between adjacent carding devices of adjacent feed systems.

26. Circular knitting machine in accordance with claim 16, wherein each carding device has an associated extraction nozzle.

27. Circular knitting machine in accordance with claim 20, wherein the extraction nozzles are each arranged between adjacent blower elements.

28. Circular knitting machine in accordance with claim 1, wherein the extraction nozzles open into a suction chamber.

29. Circular knitting machine in accordance with claim 28, wherein the extraction nozzles open into a lower end surface of the suction chamber.

30. Circular knitting machine in accordance with claim 28, wherein the suction chamber is rotationally symmetrical.

31. Circular knitting machine in accordance with claim 28, wherein an axis of the suction chamber coincides with a central axis of the circular knitting machine.

32. Circular knitting machine in accordance with claim 28, wherein an air discharge means of a suction element of the air flow means is connected to the suction chamber.

33. Circular knitting machine in accordance with claim 1, wherein an opening of the extraction nozzle is arranged so as to be set back in a radial direction in relation to needles held on the needle cylinder.

34. Circular knitting machine in accordance with claim 1, wherein a lower end of an opening of an extraction nozzle is arranged in vertical direction above an aperture opening of a blower element of the air flow guiding device.

35. Circular knitting machine in accordance with claim 1, wherein a seal is arranged between the extraction nozzle and the carding device.

* * * * *